United States Patent [19]

Ackerman

[11] 4,299,436

[45] Nov. 10, 1981

[54] ELECTRICAL CONNECTOR

[75] Inventor: Daniel W. Ackerman, Binghamton, N.Y.

[73] Assignee: Universal Instruments Corporation, Binghamton, N.Y.

[21] Appl. No.: 119,153

[22] Filed: Feb. 6, 1980

[51] Int. Cl.[3] ..... H01R 4/48

[52] U.S. Cl. ..... 339/258 R

[58] Field of Search ..... 339/256 R, 258 R, 258 P, 339/259 R, 276 SF

[56] References Cited

U.S. PATENT DOCUMENTS

| | | | |
|---|---|---|---|
| 3,269,805 | 8/1966 | Evans | 29/874 |
| 3,363,224 | 1/1968 | Gluntz | 339/258 R |
| 3,663,931 | 5/1972 | Brown | 339/256 R |
| 3,836,947 | 9/1974 | Yeager | 339/259 R |

*Primary Examiner*—John McQuade

*Attorney, Agent, or Firm*—Fidelman, Wolffe & Waldron

[57] ABSTRACT

A female contact formed of a unitary piece of metal is provided. The contact includes an opposed pair of cantilevered contact blades so arranged as to preclude overstressing of the blades upon insertion or withdrawal of a mating male pin terminal.

3 Claims, 4 Drawing Figures

ELECTRICAL CONNECTOR

BACKGROUND OF THE INVENTION

This invention relates generally to electrical contacts or terminals for removable attachement thereto of conductive elements.

More particularly, this invention relates to a female contact having a pair of opposed, cantilevered spring contact blades for use in association with male pin terminals.

Female contacts of the general type to which this invention is directed are conventionally used for the interconnection of printed circuit boards and other modular electrical components. Such contacts must be relatively inexpensive because of the large number used, must withstand repeated cycling with mating male pin contacts without loss of electrical continuity and ideally should be readily amenable to machine forming and use with automatic insertion machinery.

One of the problems encountered in the use of prior art contacts is in the overstressing, or bending to a set, of the contact blades during insertion or withdrawal of the male pins. This problem is particularly severe with contacts formed from a unitary piece of metal.

An approach taken in the prior art to avoiding overstressing spring contact blades is illustrated in U.S. Pat. No. 3,363,224. The contact described in that patent required either a coined or embossed tab area which overlies the free ends of cantilevered spring contact blades.

Brown in U.S. Pat. No. 3,663,931 discloses a contact having a pair of spring members tapering from a large cross-section to a relatively small cross-section at the connection pin engaging contact throat area with a pair of tab members limiting movement of the spring tips.

U.S. Pat. No. 3,270,251 illustrates a female contact having a pair of spring tongues formed in the contact sidewall with tab members overlying the free tongue ends to limit outward movement upon insertion of a male contact.

Another contact formed of sheet metal stock is shown in U.S. Pat. No. 3,362,008. This contact comprises a pair of inwardly bowed spring portions, each coined to a decreased thickness toward its centers and carrying an alignment tab medially located thereon.

Formation of female contacts from a blanked strip is illustrated in U.S. Pat. No. 3,269,805. Each contact unit blank comprises three parallel, transverse portions; the intermediate portion being substantially twice as wide as the outermost portion of each blank.

SUMMARY OF THE INVENTION

The contact of the instant invention comprises an elongated rectangular housing having a pair of tines for mounting the contact on a circuit board and a pair of cantilevered spring tongues for engagement with a male pin connector all formed as by stamping from a continuous ribbon of sheet metal. The spring tongues comprise a portion of the top and bottom of the contact housing. Overstressing of the bottom spring tongue is prevented by the surface of the printed circuit board upon which the contact is mounted and which limits the outward movement of the lower tongue member. An ear portion is formed to overlie the free end of the top spring tongue thus limiting its outward movement so as to prevent overstressing of that member.

Hence, it is an object of this invention to provide a female contact formed of a single piece of metal.

A further object of this invention is to provide a female contact having cantilevered spring tongues and associated means to prevent overstressing of the spring tongues upon insertion of a male pin connector.

Yet another object of this invention is to provide a blanked strip from which female contacts may be formed and automatically inserted into a circuit board.

Other objects, advantages and novel features of the invention will become apparent from the following detailed description and accompanying drawing.

DETAILED DESCRIPTION OF THE INVENTION

Figure 1:
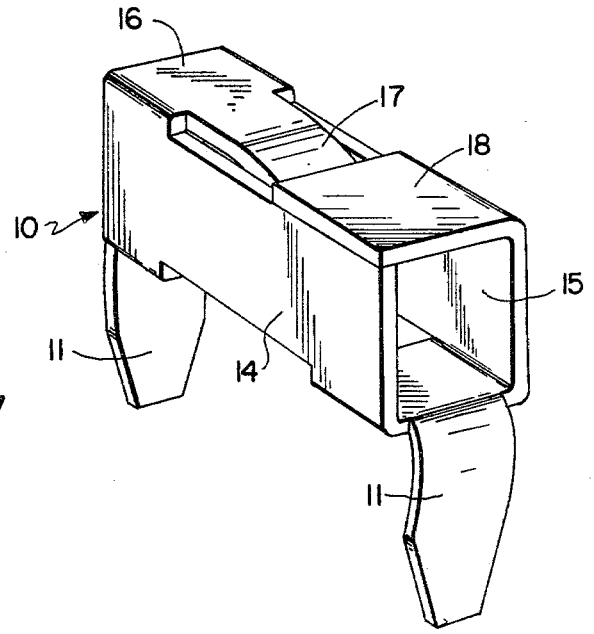
FIG. 1 is a top perspective view of the contact.

The invention will be more clearly understood by reference to the drawing in which like numerals refer to like elements on each of the Figures.

Figure 2:
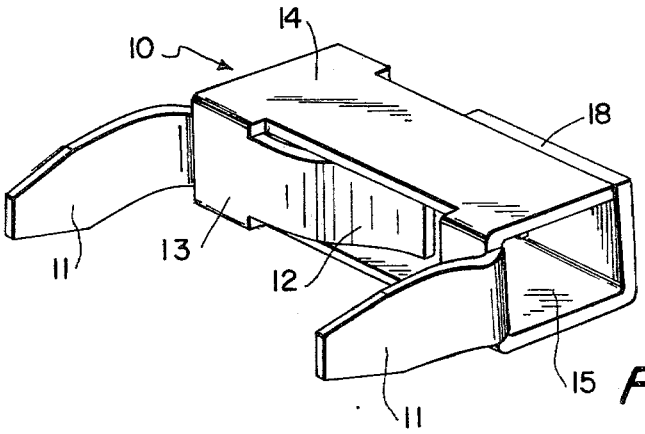
FIG. 2 is a bottom perspective view of the contact.

Referring first to FIGS. 1 and 2, female contact 10 is fabricated from a single piece of resilient metal and is shaped to form a generally rectangular housing. Disposed at each end of the housing bottom are tines 11 which are adapted for mounting the contact on a circuit board or other surface. The contact bottom comprises an elongated tongue member 12 extending from tongue base 13 and biased upwardly into the interior of the contact housing to form one member of a pair of cantilevered contact surfaces which mate with a male pin connector.

A pair of housing wall members 14 and 15 are disposed perpendicularly to the contact bottom. Wall member 14 is integrally joined at one end thereof to a portion of the contact top 16 which portion forms the base of second tongue member 17. Tongue member 17 is biased inwardly into the interior of the contact housing to form a second member of the pair of cantilevered contact surfaces. Overlying member 17 at its free end is ear 18. Ear 18 is formed as an extension of wall member 15 and is disposed perpendicular thereto and parallel to the contact bottom.

Figure 3:
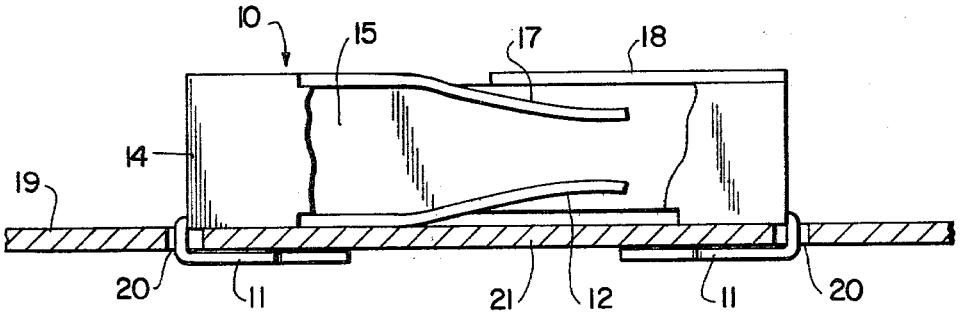
FIG. 3 is a partially cut away side view of the contact mounted on a circuit board.

FIG. 3 illustrates in a partial cut away view the contact of this invention as mounted on a substrate such as a printed circuit board. Contact 10 is mounted on printed circuit board 19 by inserting tines 11 through bored holes 20 and thereafter crimping the tines as illustrated. The circuit board portion 21 underlying the upwardly biased tongue 12 acts to limit the downward movement of tongue 12 thus preventing the overstressing of that member upon insertion and withdrawal of a male pin connector. Likewise, ear 18 acts to limit the outward or upward movement of tongue 17 so as to prevent overstressing of that member. In this way, the biased tongue members 12 and 17 will not take a set and will continue to apply a steady force to a male pin connector even after repeated insertions and withdrawals.

Figure 4:
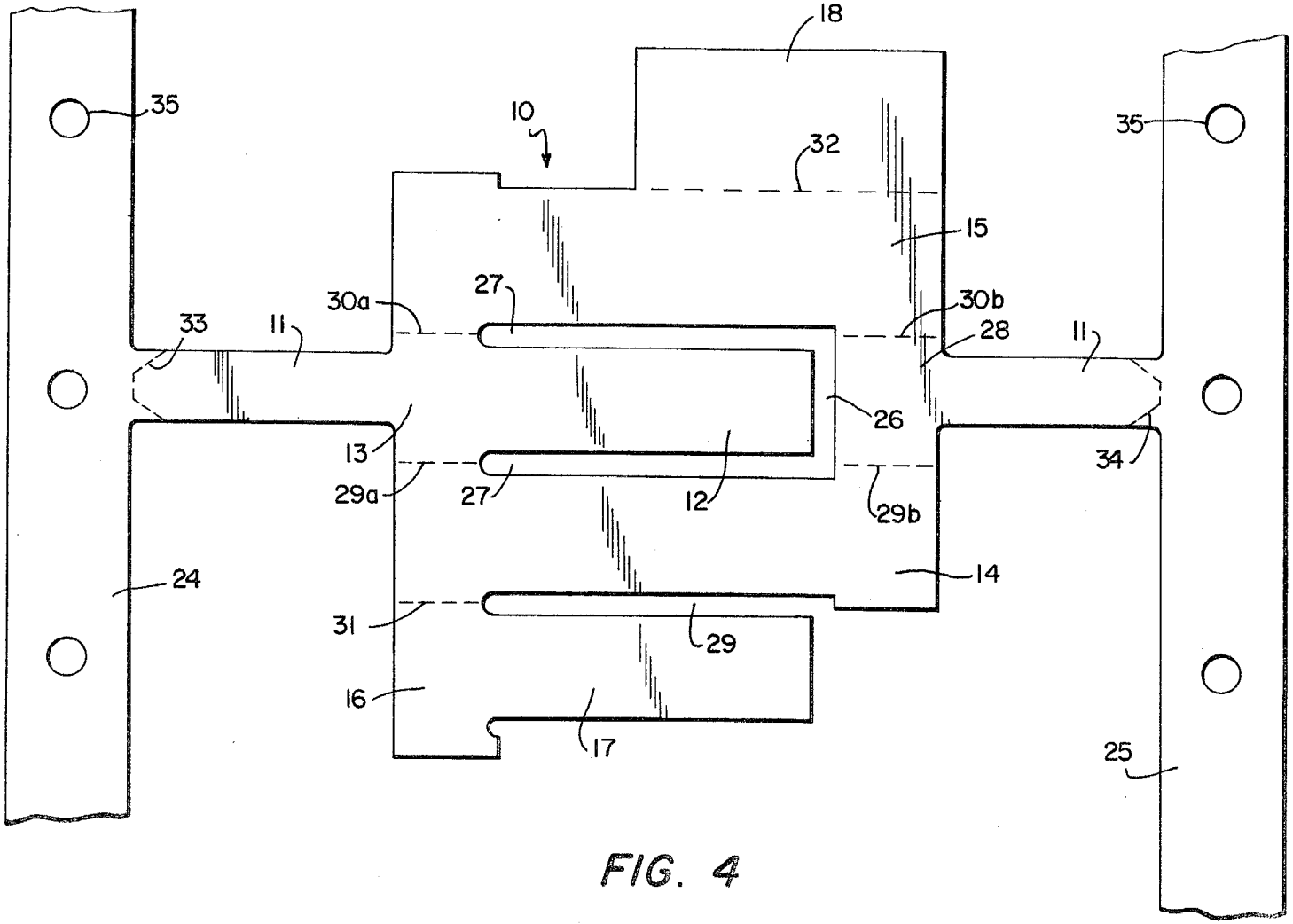
FIG. 4 is a fragmentary section of a blanked strip illustrating the manner in which the contacts of FIGS. 1–3 are initially formed.

Referring now to FIG. 4, there is shown the female contact of the present invention in its flat, blanked strip form prior to bending. The contact 10 is connected at opposite ends to a pair of margin strips 24 and 25 by means of webs which, when severed from the margin strips, form tines 11. Each contact unit blank is made up of five parallel transverse portions. The center portion, connected at each end to tines 11, comprises the contact bottom. A generally U-shaped channel is cut from the contact blank, the base 26 of the channel extending perpendicularly across the length of the center portion near one end thereof. The channel legs 27 extend from base 26 for a major part of the center portion length define the sides of the center portion and form tongue member 12 which extends into the channel.

Disposed adjacent one side of the center portion is wall member 14 of equal length to the center portion and attached thereto at either end through tongue base 13 and web portion 28. A second tongue member 17, formed by a linear cut away channel 29, is disposed in a cantilevered attitude through contact top portion 16. The free end of tongue member 17 preferably is coincident with the end of first tongue member 12; the two members forming a pair of biased, cantilevered contacts to engage a male pin contact upon bending the blank to its final form.

A second wall member 15 is disposed adjacent the other side of the center portions and is attached thereto at either end through tongue base 13 and weg portion 28. Member 15 is of equal length to the center portion. An ear member 18 projects from wall 15 at that end of member 15 opposite the base of tongue members 12 and 17. One end of ear 18 is coextensive with an end of wall 15 and the other end is situated so as to overlie an end portion of tongue member 17 in the finished contact.

Each contact unit blank is shaped into assembled form by a series of bending operations. Wall members 14 and 15 are bent upwardly to an attitude substantially perpendicular to center portion 13 along fold lines 29*a*–29*b* and 30*a*–30*b* respectively. Tongue member 12 is bent into an upwardly biased position as is best shown in FIGS. 2 and 3. Contact top portion 16 is then bent along fold line 31 at substantially a right angle to wall 14 so as to be positioned above and substantially parallel to center portion 13. Likewise, ear 18 is bent at a right angle to wall 15 along fold line 32 so as to overlie at least the end of second tongue member 17 which in turn is biased downwardly toward and symmetrical with member 12 so as to form a pair of cantilevered contact blades.

The contact 10 is fabricated of a resilient, electrically conductive metal. For example, brass alloy 260, Grade A, ½ hard, having a thickness of about 0.010 inch may be utilized. The metal may be plated, as with a tin-lead or tin plating over a plating of copper, so as to enhance the electrical conductivity of the contact surfaces. Platings in a thickness range from about 0.0001 to 0.0005 inch are suitable. As well as enhancing electrical conductivity of contact surfaces, plating provides general corrosion resistance, improved solderability and a better appearance. Plating may be done either before or after stamping to form the contact unit blanks.

In use, contact 10 is mounted on a printed circuit board or similar surface by inserting tines 11 through mating holes in the board and thereafter bending and clinching the tine portion extending through the board. Although amenable to hand insertion, the terminals 10 of this invention are expressly designed for use with automatic insertion machinery. In an automatic insertion machine (not shown) the tines 11 are severed from the margin strips 24 and 25 along lines 33 and 34 respectively. The two tines of the separated contact are then bent perpendicularly to the contact bottom as is best shown in FIGS. 1 and 2 and are thereafter inserted into mating holes in a printed circuit board. Spaced holes 35 in margin strips 24 and 25 are useful in transporting the strip both for automated stamping and forming operations and also in the bending and insertion head of the insertion machine.

When used with mating pin terminals, the contacts of this invention provide quick pluggability for service and interchanging of circuit modules. The contact design which prevents overstressing of either of the two cantilevered contact blades allows repeated insertions and withdrawals without loss of continuity or significant increase in electrical resistance.

What is claimed is:

1. A female contact formed of a single piece of metal comprising:

an elongated housing of generally rectangular form;

a pair of tines for securing said contact on a board member, one tine extending from each end of the bottom of said housing;

a generally U-shaped channel, the base of said channel extending transversely across the bottom of said housing, the legs of said channel extending parallel with and defining the sides of said housing bottom over a portion of its length;

an elongated first tongue member forming a portion of said housing bottom and extending into said channel, said tongue member biased inwardly into said housing;

a pair of housing wall members adjacent said housing bottom and generally perpendicular thereto;

a second tongue member attached only to one of said wall members at one end thereof, said second tongue member forming a portion of the top of said housing and biased inwardly into said housing; and an ear member forming a second portion of said housing top and attached only to the other of said wall members, said ear member overlying the end portion of said second tongue member to thereby limit the outward movement of said second tongue member upon insertion of a male contact.

2. Partially formed electrical connectors in unitary form adapted for automatic insertion and clinching, each of said connectors comprising:

an elongated housing of generally rectangular form, the bottom of said housing connected to a pair of spaced margin strips by web means extending between each end of said housing bottom and said margin strips;

a generally U-shaped channel, the base of said channel extending transversely across the bottom of said housing, the legs of said channel extending parallel with and defining the sides of said housing bottom over a portion of its length;

an elongated first tongue member forming a portion of said housing bottom and extending into said channel, said tongue member biased inwardly into said housing;

a pair of housing wall membes adjacent said housing bottom and generally perpendicular thereto;

a second tongue member attached only to one of said wall members at one end thereof, said second tongue member forming a portion of the top of said housing and biased inwardly into said housing; and an ear member forming a second portion of said housing top and attached only to the other of said wall members, said ear member overlying the end portion of said second tongue member to thereby limit the outward movement of said second tongue member upon insertion of a male contact.

3. A blanked strip from which female contacts are to be formed comprising:

a continuous ribbon of resilient metal formed to provide a pair of spaced margin strips at opposite edges of the ribbon and contact unit blanks extending between and connected at opposite ends to said margin strips, each said unit blank comprising five parallel transverse portions;

a center transverse portion having elongated webs extending from the center portion ends to said margin strips;

a generally U-shaped cut out channel, the base of said channel extending across said center transverse portion perpendicular to the length thereof and near one end thereof, the legs of said channel forming the edges of said center transverse portion over a major part of its length;

a first and a second housing wall portion, each said wall portion adjacent a side of said center transverse portion, each said wall portion being of the same length as said center portion;

an elongated tongue portion having a base adjacent to and coincident with one end of said first wall portion, the end of said elongated tongue portion coinciding with the base of said U-shaped channel, and an ear portion adjacent to and shorter than said second wall portion, one end of said ear portion overlapping the end of said elongated tongue portion.

* * * * *